US010989208B2

(12) United States Patent
Chen

(10) Patent No.: US 10,989,208 B2
(45) Date of Patent: Apr. 27, 2021

(54) AIR CIRCULATION DEVICE

(71) Applicant: SMB Technology Corporation, Taichung (TW)

(72) Inventor: Mao Sheng Chen, Taichung (TW)

(73) Assignee: SMB TECHNOLOGY CORPORATION, Taichung (TW)

( * ) Notice: Subject to any disclaimer, the term of this patent is extended or adjusted under 35 U.S.C. 154(b) by 42 days.

(21) Appl. No.: 16/249,402

(22) Filed: Jan. 16, 2019

(65) Prior Publication Data

US 2020/0224662 A1 Jul. 16, 2020

(51) Int. Cl.

| | |
|---|---|
| ***F04D 25/08*** | (2006.01) |
| ***F04D 19/00*** | (2006.01) |
| ***F04D 29/56*** | (2006.01) |
| ***F04D 29/54*** | (2006.01) |
| ***F04D 25/06*** | (2006.01) |
| ***F24F 13/062*** | (2006.01) |

(52) U.S. Cl.

CPC ..... *F04D 25/088* (2013.01); *F04D 19/002* (2013.01); *F04D 25/068* (2013.01); *F04D 29/541* (2013.01); *F04D 29/547* (2013.01); *F04D 29/563* (2013.01); *F24F 13/062* (2013.01)

(58) Field of Classification Search

CPC .... F04D 29/441; F04D 29/442; F04D 29/547; F04D 29/46; F04D 29/462; F04D 29/464; F04D 25/088; F04D 25/10; F04D 19/002; F04D 17/06; F04D 27/002; F04D 29/541; F04D 29/563; F04D 25/068; F21V 33/00; F21V 33/0096; F24F 1/0018; F24F 1/028; F24F 1/0047; F24F 2013/205; F24F 13/062

See application file for complete search history.

(56) References Cited

U.S. PATENT DOCUMENTS 3,812,770 A * 5/1974 Morozov ..... F24F 13/06 454/285
4,356,535 A * 10/1982 Chu ..... F04D 25/06 362/216
5,133,693 A * 7/1992 Blomster ..... F24F 13/062 454/312

(Continued)

FOREIGN PATENT DOCUMENTS

TW I509159 B 11/2015
WO WO-2006136647 A1 * 12/2006 ..... F24F 13/06

*Primary Examiner* — Nathan C Zollinger

(74) *Attorney, Agent, or Firm* — Muncy, Geissler, Olds & Lowe. P.C.

(57) ABSTRACT

An air circulation device includes a support frame, a fan, a wind guiding plate disposed below the fan, and a housing. The support frame is provided for being fixed on a ceiling, and a fan motor is fixed on the support frame. The fan is connected to the fan motor. The wind guiding plate has a guiding surface facing the fan. The housing encloses the fan and the wind guiding plate. A bottom portion of the housing has a skirt portion extending and expanding to a periphery of the wind guiding plate. A guiding space and a wind outlet are formed between the skirt portion and the guiding surface. An area and a direction of the wind outlet are changeable by moving the housing relative to the wind guiding plate, so that a wind output and a wind direction of the air circulation device are adjustable.

4 Claims, 2 Drawing Sheets

(56) References Cited

U.S. PATENT DOCUMENTS

| | | | | |
|---|---|---|---|---|
| 2012/0146481 | A1* | 6/2012 | Li | F21V 29/74 313/46 |
| 2017/0234319 | A1* | 8/2017 | Seccareccia | F04D 29/582 415/203 |
| 2019/0234423 | A1* | 8/2019 | Schaafsma | F04D 29/547 |

* cited by examiner

AIR CIRCULATION DEVICE

BACKGROUND OF THE INVENTION

Field of the Invention

The present invention relates to an air circulation device, in particular to an air circulation device capable of changing the wind power and the wind direction.

Description of the Prior Art

Fans hung below the ceiling are called ceiling fans. The fan blades of a common ceiling fan are exposed, and when the fan blades are driven to rotate, airs flow to generate winds. However, dusts may be easily collected by the exposed fan blades, and when the fan blades are rotated, the dusts are further blown out to the circumstance to make the circumstance become dirty.

Therefore, a conventional ceiling fan with the fan blades hidden inside, as disclosed in Taiwan Patent number 1509159, is developed. To the conventional ceiling fan, a housing encloses the fan blades, a guiding surface is inside the housing, and a wind outlet is at the periphery of the housing. Therefore, when the fan blades are rotated, air flows flow along the guiding surface and are blown out from the wind outlet. However, in the conventional ceiling fan, the wind outlet is fixed, and the area and the direction of the wind outlet cannot be adjusted. As a result, the conventional ceiling fan can only provide winds with fixed volume and fixed direction. The wind power and the wind direction cannot be adjusted according to actual requirements.

SUMMARY OF THE INVENTION

One object of the present invention is to provide an air circulation device having a wind output with changeable area and direction. Therefore, the wind power and the wind direction of the output flows can be adjusted, thereby improving the area of the blowing range and the convenience in using the device.

In view of these, an air circulation device is provided. In one embodiment, the air circulation device comprises a support frame, a fan, a wind guiding plate, and a housing. The support frame is provided for being fixed on a ceiling, and a fan motor is fixed on the support frame. The fan is connected to the fan motor. The wind guiding plate is disposed below the fan. The wind guiding plate has a guiding surface facing the fan, and the guiding surface is arc shaped. The housing encloses the fan and the wind guiding plate. A bottom portion of the housing has a skirt portion extending and expanding to a periphery of the wind guiding plate. A guiding space and a wind outlet are formed between the skirt portion and the guiding surface, and the wind outlet is ring shaped. An area and a direction of the wind outlet are changeable by moving the housing relative to the wind guiding plate, so that a wind output and a wind direction of the air circulation device is adjustable.

In one embodiment, a control motor is further fixed on the support frame, and a driving shaft having a threaded portion is extending from the control motor. The housing comprises a rib aligned in a lateral direction, and the rib comprises a threaded hole. The driving shaft is threaded with the threaded hole, so that the housing is moved relative to the wind guiding plate when the control motor drives the driving shaft to rotate.

In one embodiment, a plurality of guiding blocks is provided on the guiding surface of the wind guiding plate, and each of the guiding blocks is outwardly and curvedly extending from a center of the guiding surface.

In one embodiment, the housing comprises a plurality of wind inlets spaced apart from each other as a fence-like structure.

In one embodiment, the wind guiding plate comprises a lamp.

DETAIL DESCRIPTION OF THE PREFERRED EMBODIMENTS

Figure 1:
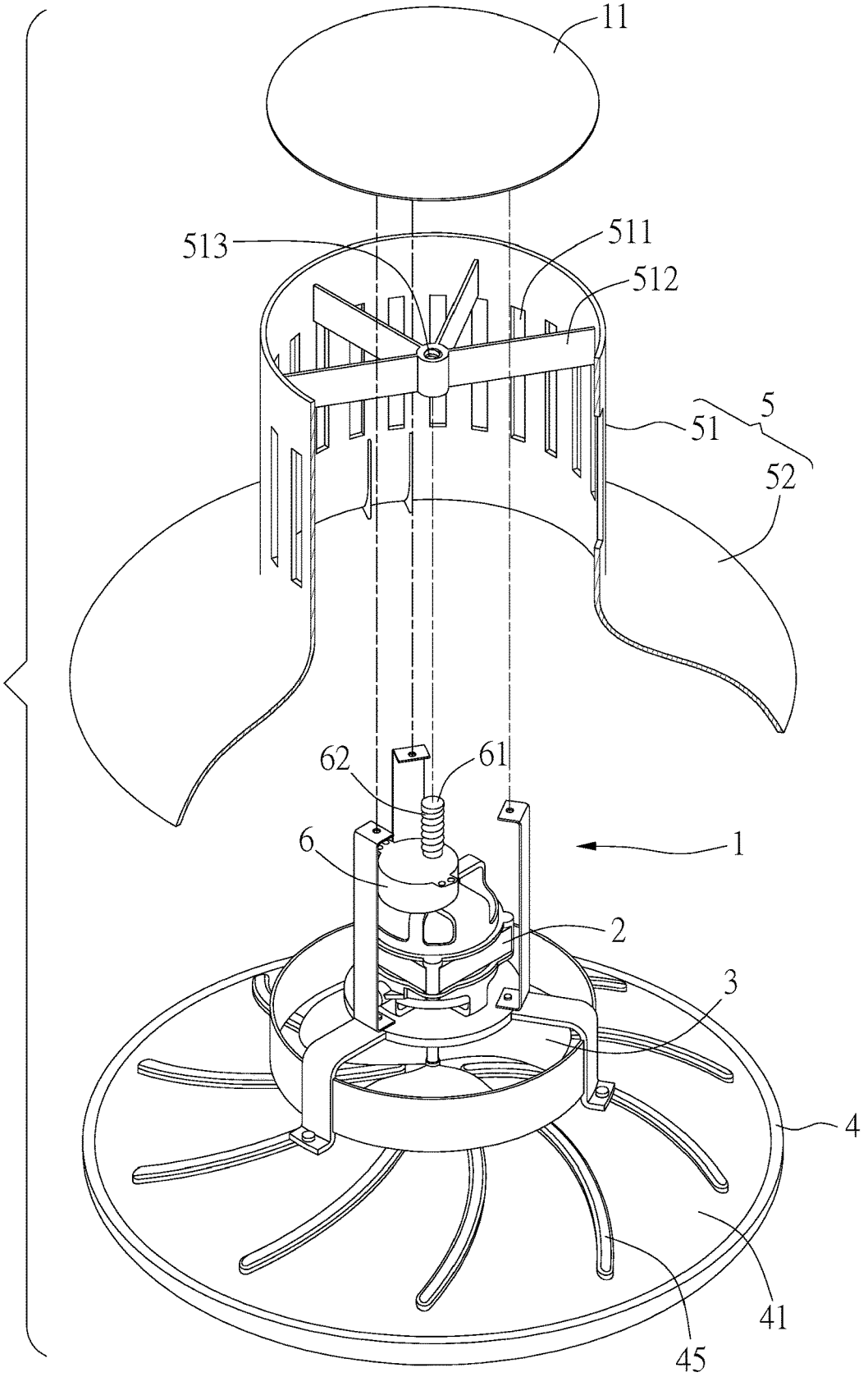
FIG. 1 illustrates an exploded view of an air circulation device according to an embodiment of the present invention.
Figure 2:
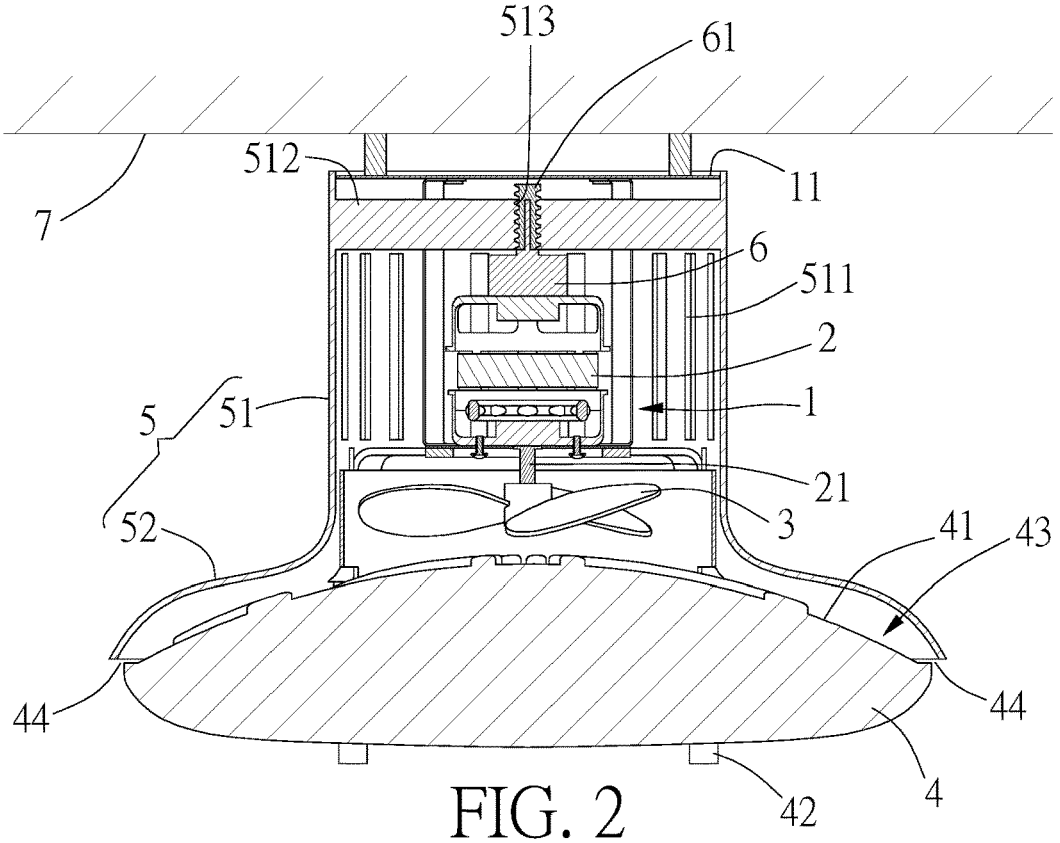
FIG. 2 illustrates a sectional view of the air circulation device.

Please refer to FIGS. 1 and 2, illustrating an air circulation device according to an embodiment of the present invention. The air circulation device comprises a support frame 1 formed by several bars and plates. The support frame 1 is a rigid structure for fixing a fan motor 2. A top portion of the support frame 1 has a top plate 11, and the top plate 11 may be locked on the ceiling 7 by bolts or other fastening components, so that the support frame 1 can be fixed on the ceiling 7.

Moreover, a transmission shaft 21 is extending downwardly from the fan motor 2 and the transmission shaft 21 is connected to a fan 3, so that the fan motor 21 drives the fan 3 to rotate through the transmission shaft 21 to generate winds. After the transmission shaft 21 passes through the fan 3, the transmission shaft 21 is further downwardly connected to a wind guiding plate 4. The wind guiding plate 4 has a arc-shaped guiding surface 41 facing the fan 3. The guiding surface 41 has a greater projection area than one of the fan 3. In this embodiment, a bottom portion of the guiding plate 4 further comprises a lamp 42 to improve the functionality and the decorativeness of the air circulation device.

Further, a housing 5 encloses the fan 3 and the wind guiding plate 4. An upper portion of the housing 5 has a cylindrical portion 51 enclosing the support frame 1 and the fan 3. The cylindrical portion 51 comprises a plurality of wind inlets 511, and the wind inlets 511 are spaced apart from each other to allow the cylindrical portion 51 to have a fence-like structure. A bottom portion of the housing 5 has a skirt portion 52 expanding outwardly. The skirt portion 52 is extending to a periphery of the wind guiding plate 4, and encloses above the wind guiding plate 4. A guiding space 43 is formed between the skirt portion 42 and the guiding surface 41, a wind outlet 44 is formed at the gap between the periphery of the skirt portion 42 and the periphery of the wind guiding plate 4, and the wind outlet 44 is ring shaped. When the fan 3 rotates, the air flows driven by the fan 3 enter into the housing 5 from the wind inlets 511, and the air flows further flow downwardly and are blocked by the wind guiding plate 4, so that the air flows flow laterally along the guiding surface 41 in the guiding space 43 and are blown out from the wind outlet 44.

In this embodiment, a plurality of guiding blocks 45 is provided on the guiding surface 41 of the wind guiding plate 4, and each of the guiding blocks 45 is outwardly and curvedly extending from center of the guiding surface 41. Accordingly, the flow of the air flows on the guiding surface 41 form whirls according to the shape of the guiding blocks 45, thereby improving the wind speed blown from the wind outlet 44.

Moreover, a control motor 6 is fixed on the support frame 1, and the control motor 6 is located above the fan motor 2. A driving shaft 61 is extending upwardly from the control motor 6, and the driving shaft 61 has a threaded portion 62. On the other hand, a rib 512 aligned in a lateral direction is provided in the cylindrical portion 51 of the housing 5, the rib 512 has a threaded hole 513, and the driving shaft 61 is threaded in the threaded hole 513.

Figure 3:
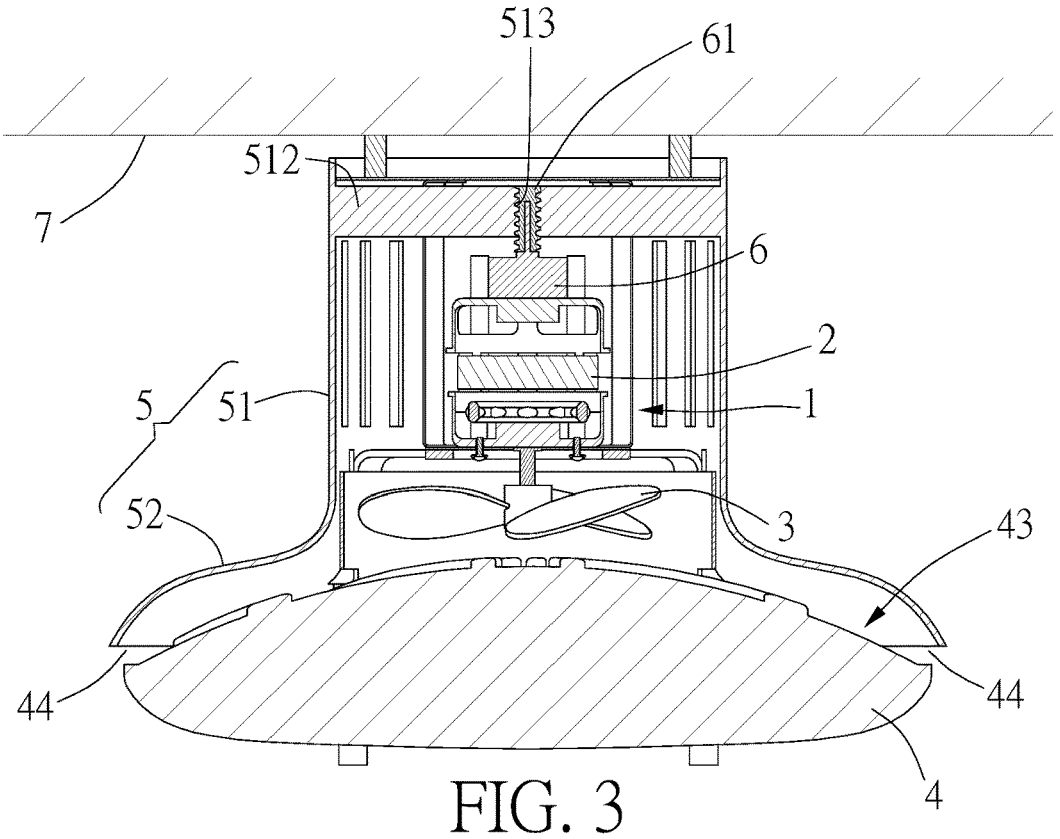
FIG. 3 illustrates an operational view of the air circulation device.

According to one or some embodiments of the present invention, since the control motor 6, the fan motor 2, and the support frame 1 are integrally fixed together and are fixed with the ceiling 7, when the control motor 6 drives the driving shaft 61 to rotate, the rib 512 performs an up and down movement, so that the rib 512 drives the housing 5 to move. The housing 5 is moved relative to the wind guiding plate 4 to change the position of the skirt portion 52 as well as changing the area and the direction of the wind outlet 44. In detail, as shown in FIG. 2, when the skirt portion 52 is relatively closer to the wind guiding plate 4, the wind outlet 44 has a smaller area and the wind direction is a downward direction; while when the skirt portion 52 moves away from the wind guiding plate 4, as shown in FIG. 3, the wind outlet 44 has a larger area and the wind direction becomes a lateral direction. Accordingly, the area and the direction of the wind outlet 44 are changeable by moving the housing 5 relative to the wind guiding plate 4, so that a wind output and a wind direction of the air circulation device are adjustable, and the area of the blowing range can be increased.

What is claimed is:

1. An air circulation device, comprising:

a support frame for being fixed on a ceiling, wherein a fan motor and a control motor are respectively fixed on the support frame, and a driving shaft having a threaded portion is extending from the control motor;

a fan connected to the fan motor;

a wind guiding plate disposed below the fan, wherein the wind guiding plate has a guiding surface facing the fan, and the guiding surface is arc shaped; and a housing enclosing the fan and the wind guiding plate, wherein a bottom portion of the housing has a skirt portion extending to a periphery of the wind guiding plate; a guiding space and a wind outlet are formed between the skirt portion and the guiding surface, and the wind outlet is ring shaped; the housing comprises a rib aligned in a lateral direction, and the rib comprises a threaded hole; the driving shaft is threaded with the threaded hole so that the housing is selectively driven toward and away from the wind guiding plate when the control motor drives the driving shaft to rotate, and then an area and a direction of the wind outlet are changed to adjust a wind output and a wind direction.

2. The air circulation device according to claim 1, wherein a plurality of guiding blocks is provided on the guiding surface of the wind guiding plate, and each of the guiding blocks is outwardly and curvedly extending from a center of the guiding surface.

3. The air circulation device according to claim 1, wherein the housing comprises a plurality of wind inlets spaced apart from each other as a fence-like structure.

4. The air circulation device according to claim 1, wherein the wind guiding plate comprises a lamp.

* * * * *